United States Patent [19]

Yonemoto

[11] 4,354,577

[45] Oct. 19, 1982

[54] SPEED INSTRUCTION GENERATING DEVICE FOR ELEVATOR

[75] Inventor: Masashi Yonemoto, Inazawa, Japan

[73] Assignee: Mitsubishi Denki Kabushiki Kaisha, Tokyo, Japan

[21] Appl. No.: 272,239

[22] Filed: Jun. 10, 1981

[30] Foreign Application Priority Data

Jun. 18, 1980 [JP] Japan ..... 55/82363

[51] Int. Cl.[3] ..... B66B 1/30

[52] U.S. Cl. ..... 187/29 R

[58] Field of Search ..... 187/29

[56] References Cited

U.S. PATENT DOCUMENTS

| | | | |
|---|---|---|---|
| 3,777,854 | 12/1973 | Ozawa | 187/29 |
| 4,050,547 | 9/1977 | Kataoka et al. | 187/29 |
| 4,150,734 | 4/1979 | Ohira et al. | 187/29 |
| 4,155,426 | 5/1979 | Booker, Jr. | 187/29 |

*Primary Examiner*—J. V. Truhe

*Assistant Examiner*—W. E. Duncanson, Jr.

*Attorney, Agent, or Firm*—Sughrue, Mion, Zinn, Macpeak & Seas

[57] ABSTRACT

A method for controlling the movement of an elevator cage in which a difference between first and second speed instruction values is made constant irrespective of speed so that no shock force is applied to the cage at a time of switching between speed instruction values. A predetermined distance is added to a remaining distance of the age to a target floor. A modified second speed instruction value corresponding to the resultant distance is compared with the first speed instruction value, and when this difference becomes smaller than a predetermined value, a switching preparation instruction is issued. The elevator is operated at a speed determined by the first speed instruction value until a predetermined period of time after the switching preparation instruction after which the elevator is operated in accordance with the second speed instruction value.

8 Claims, 10 Drawing Figures

SPEED INSTRUCTION GENERATING DEVICE FOR ELEVATOR

BACKGROUND OF THE INVENTION

The present invention relates to a device for generating speed instruction values for an elevator.

The speed of an elevator cage is controlled by a speed instruction value. In a known elevator speed control system, a first speed instruction value which varies with time during acceleration and a second speed instruction value which decreases during deceleration are available. This will be described with reference in FIG. 1.

In FIG. 1, reference character Vp designates a speed instruction value, $Vp_1$ a first speed instruction value during high speed running, $Vp_2$ a first speed instruction value during low speed running (short distance running), and Vd a second speed instruction value.

During high speed running, the first speed instruction value $Vp_1$ increases from a start point $O_1$. When the value $Vp_1$ increases to a point $A_1$ corresponding to a speed instruction value $v_{11}$, a switching preparation instruction is issued which results in the value $Vp_1$ undergoing a transition from $A_1$ to $D_1$ to $F_1$ with time. When the two speed instruction values become equal to each other at the point $F_1$, the first speed instruction value is switched over to the second speed instruction value Vd. As a result, the speed instruction value Vp follows the locus $O_1$, $A_1$, $D_1$, $F_1$ and H indicated in FIG. 1, where H represents a point where the cage is to be stopped, namely, a floor from which the cage is called. The speed of the winding motor and hence the speed of the cage is controlled by the speed instruction value Vp.

When the cage while being run is called to a floor, the distance between the cage and the floor (hereinafter referred to as "a remaining distance") is calculated momentarily. For instance at the time instant $B_1$, the remaining distance can be represented by an area $B_1$-$A_1$-$F_1$-H-$B_1$. On the other hand, as the speed instruction value Vd with respect to position for the remaining distance at the time instant $B_1$ is provided for an area $E_1$-$C_1$-$F_1$-H-$E_1$ equal to the above-described area, the speed instruction value Vd is given as a speed instruction value $v_{12}$ for the point $C_1$. The area $B_1$-$A_1$-$D_1$-$E_1$-$B_1$ is equal to the area $D_1$-$C_1$-$F_1$-$D_1$. The speed instruction values $Vp_1$ and Vd are subjected to comparison so as to detect a point $A_1$ which corresponds to the time instant $B_1$ when the difference $v_{12}-v_{11}=Vs$ therebetween reaches a predetermined value, whereupon the above-described switching preparation instruction is issued.

Similar to the above-described case, during low speed running, the first speed instruction value $Vp_2$ increases from the start point $O_2$. When the value $Vp_2$ reaches a point $A_2$ indicated by a speed instruction value $v_{21}$, a switching preparation instruction is issued whereupon the first speed instruction value makes a predetermined variation $A_2$-$D_2$-$F_2$ with time. This variation (or curve) $A_2$-$D_2$-$F_2$ has the same shape as the curve $A_1$-$D_1$-$F_1$. Therefore, as in the above-described case, the speed instruction value Vd at the time instant $E_2$ is given as a speed instruction value $v_{22}$ for the point $C_2$. The area $B_2$-$A_2$-$D_2$-$E_2$-$B_2$ is equal to the area $D_2$-$C_2$-$F_2$-$D_2$. A point $A_2$ which corresponds to the time instant $B_2$ when the difference $v_{22}-v_{21}=Vs$ reaches a predetermined value is detected. As is apparent from FIG. 1, the area $D_1$-$C_1$-$F_1$ is larger than the area $D_2$-$C_2$-$F_2$. Therefore, $v_{12}-V_{11}$ is larger than $v_{22}-v_{21}$. That is, the difference Vs varies with speed. Accordingly, it is necessary to vary the difference Vs with speed.

However, it is difficult for a conventional floor selector to adjust the value Vs accurately. Therefore, when the speed instruction value $Vp_1$ is switched over to the speed instruction value Vd, a shock force is imposed upon the passengers in the elevator cage.

Accordingly, an object of the present invention is to eliminate the above-described difficulty accompanying a conventional elevator. More specifically, an object of the invention is to provide a speed instruction generating device for an elevator in which the difference between the speed instruction value as a function of time and the speed instruction value as a function of position are made equal at the time of a switching preparation instruction irrespective of speed and yet with a simple construction.

SUMMARY OF THE INVENTION

In accordance with this and other objects of the invention, there is provided a method for controlling the movement and speed of an elevator in which the difference between a first speed instruction value and a second speed instruction value applied to slow and stop the elevator cage is constant irrespective of speed. A predetermined distance is added to a remaining distance from the position of the cage to a target floor, a second speed instruction value is modified corresponding to the resultant distance. When the difference between the modified second speed instruction value and the first speed instruction value is smaller than the predetermined value, a switching preparation instruction is issued so that the first speed instruction value is employed as the speed instruction value of the cage until a predetermined period of time has passed whereupon the cage is operated at a speed determined by the second speed instruction value.

DESCRIPTION OF THE PREFERRED EMBODIMENTS

A preferred embodiment of the invention will be described with reference to FIGS. 2 through 5.

Figure 2:
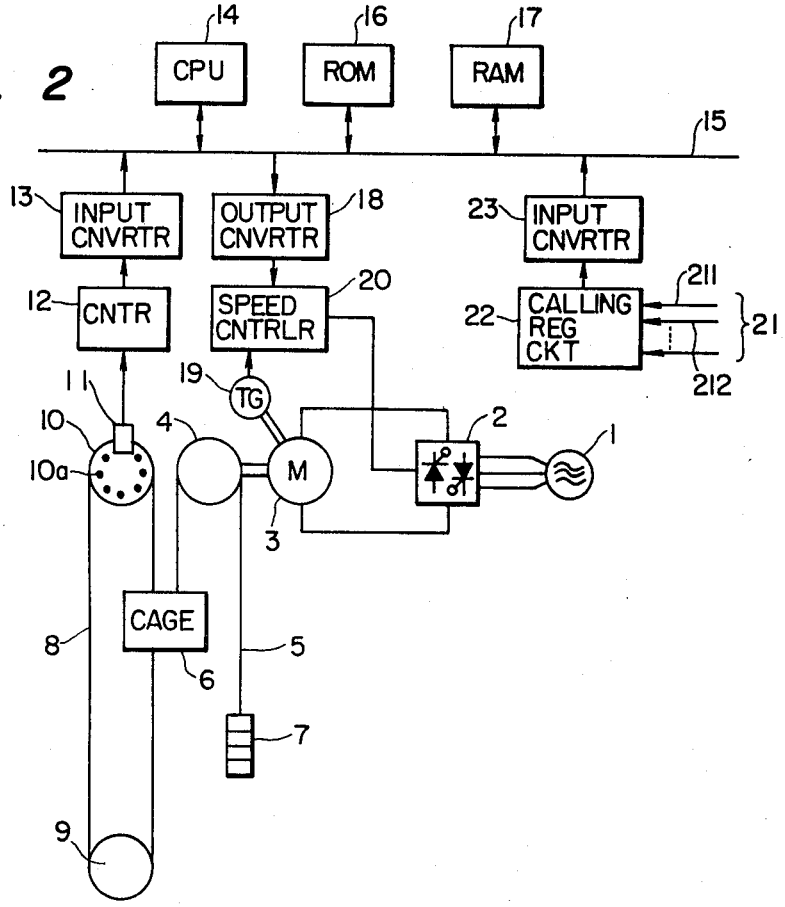
FIG. 2 is a block diagram showing a first embodiment of a speed instruction generating device according to the invention.
Figure 6:
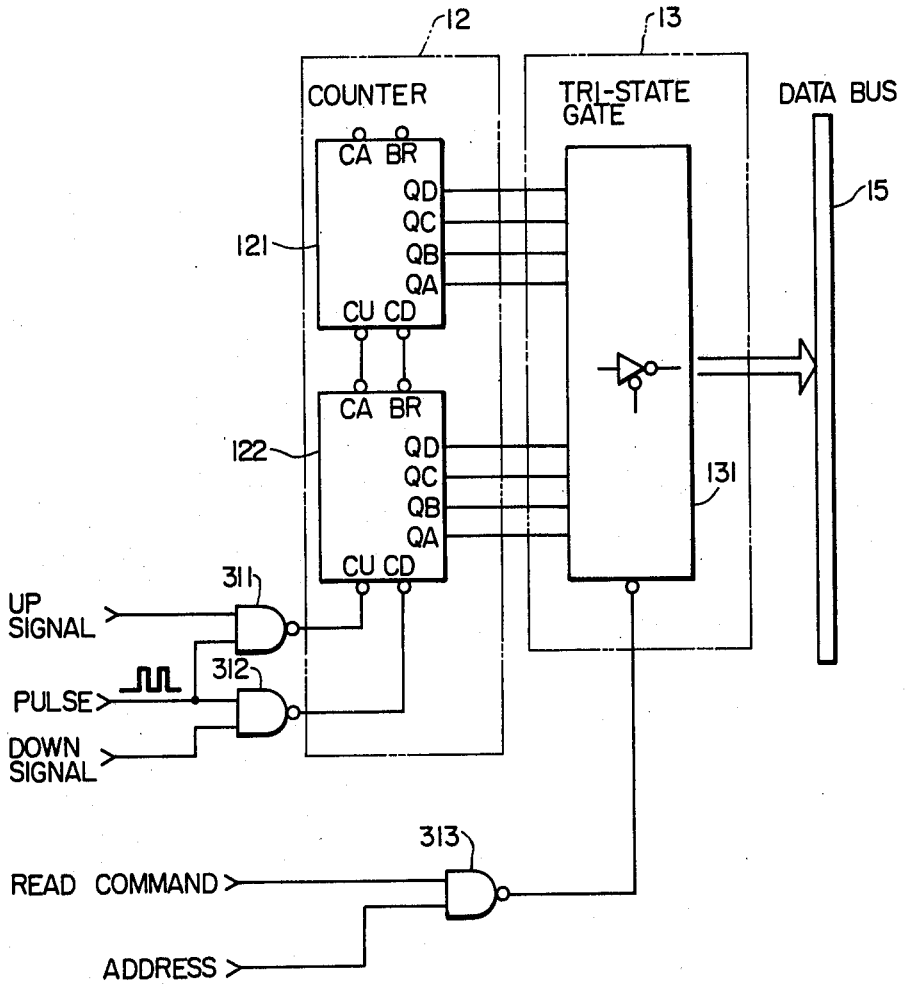
FIG. 6 is a circuit diagram, partly as a block diagram, showing an up-down counter 12 and an input converter 13 in FIG. 2.

In FIG. 2, reference numeral 1 designates a three-phase AC power source, 2 a thyristor converter for converting three-phase alternating current into direct current, 3 the armature of a hoisting DC motor coupled to the thyristor converter 2 (the field system thereof not being shown), 4 a cable sheave of a hoisting machine driven by the armature 3, 5 a main cable laid over the cable sheave 4, 6 a cage, 7 a balance weight, 8 an endless cable laid over the cage, 9 a tension sheave laid over the endless cable 8 to tension the latter, 10 a disc which is disposed in the elevator machine room and which has a number of small holes cut in the periphery at equal intervals with the cable 8 being laid over the disc 10, 11 a pulse generator for generating a pulse whenever a small hole in the disc 10 is detected thereby, and 12 an up-down counter for detecting the present position of the cage by up-counting pulses when the cage is moved upwardly and by down-counting pulses when the cage is moved downwardly. The up-down counter 12 includes two counters 121 and 122 as shown in FIG. 6. The output pulse of the pulse generator 11 and an up-signal and a down-signal are applied through two NAND gates 311 and 312 to the count inputs of the counter 121 which is coupled in cascade to the counter 122.

Further in FIG. 2, reference numeral 13 designates an input converter for converting the output of the counter 12 into data for an electronic computer, the input converter 13 including a tri-state gate as shown in FIG. 6 which is adapted to connect the outputs of the counters 121 and 122 to a data bus 15 when a read instruction is applied through a NAND gate 313 to a specified address in a CPU 14 (described below) to load the content of the counter into the CPU 14. Reference numeral 15 designates a bus including an address bus and a data bus, 16 a ROM (read-only memory) in which elevator controlling programs, speed instruction values corresponding to distance variation and numbers of output pulses of the up-down counter 12 corresponding to the floor positions are stored. For instance, in the described embodiment, the ROM may be an INTEL type 2716 manufactured by INTEL Co. 17 indicates a RAM (random access memory) for storing data at memory addresses. The RAM may be an INTEL type 2714 manufactured by INTEL Co. Denoted by 18 is an output converter for converting data from the electronic computer into a signal for controlling the elevator.

Figure 7:
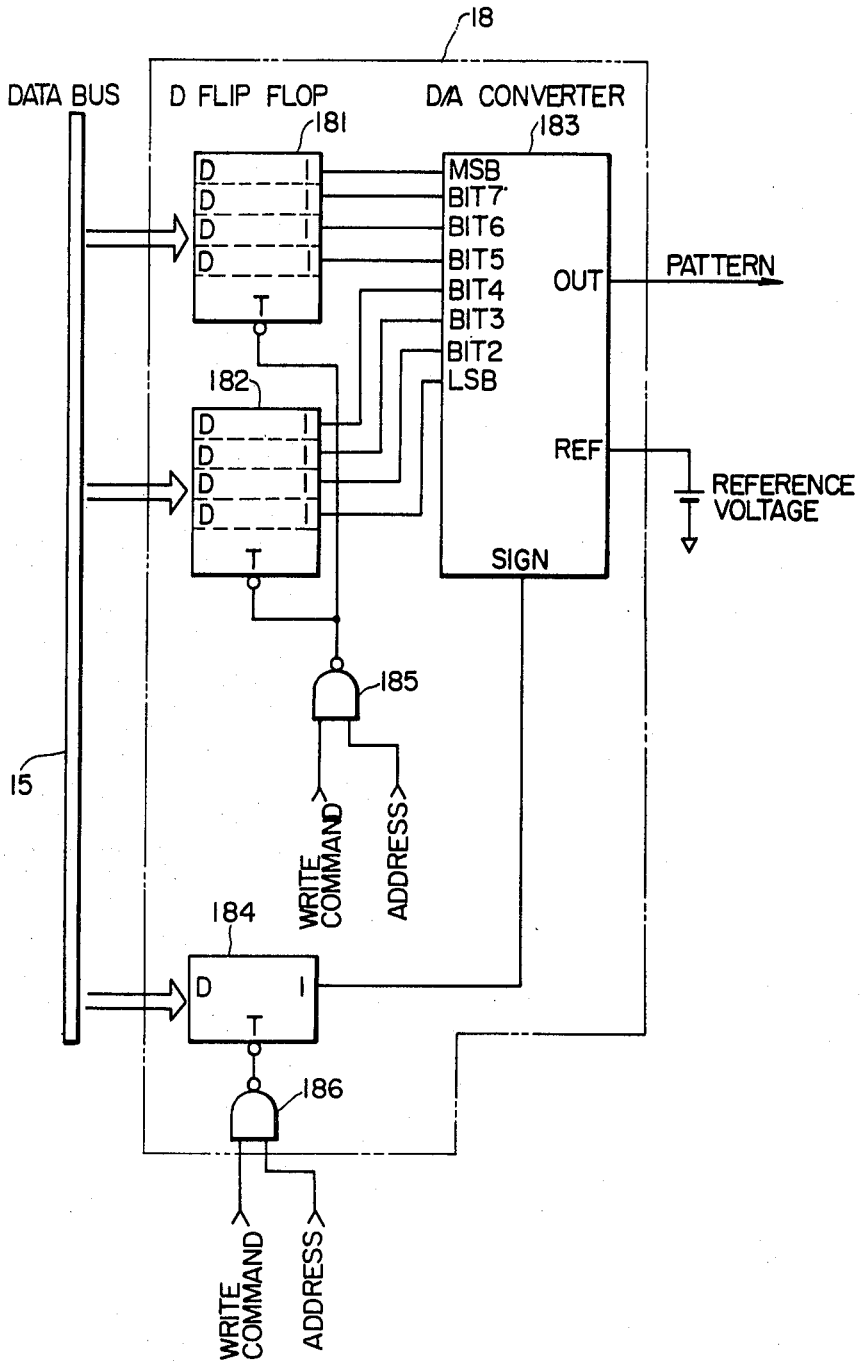
FIG. 7 is also a circuit diagram, partly as a block diagram, showing an output converter 18 in FIG. 2.

The output converter 18, as shown in FIG. 7, includes two D flip-flops 181 and 182, a D/A (digital-to-analog) converter 183, a D flip-flop 184, and NAND gates 185 and 186. In the output converter, a digital pattern value from the CPU 14 is stored by the D flip-flops 182 and 183. The outputs of the D flip-flops 182 and 183 are subjected to D/A conversion by the D/A converter 183 with the output thereon inputted as an analog signal to a speed control device 20. The polarity of the output from the D/A converter 183 is controlled by the sign bit of the D/A converter 183 to which the D flip-flop 184 and the NAND gate are connected.

Figure 8:
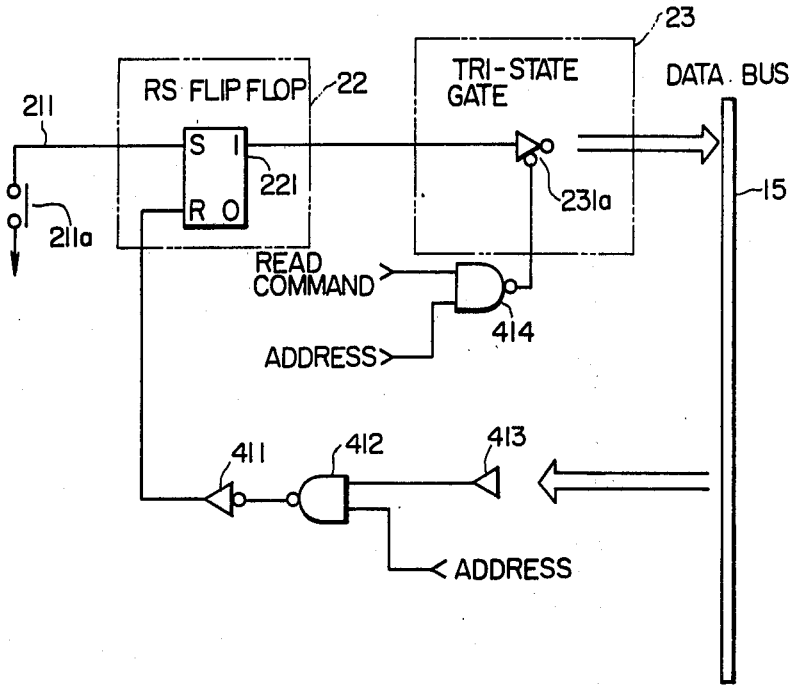
FIG. 8 is a circuit diagram, partly as a block diagram, showing a calling registering circuit 22 and an input converter 23 in FIG. 2.

Further in FIG. 2, reference numeral 19 designates a generator for a tachometer which is driven by the armature 3 and which generates an output speed signal corresponding to the speed of the cage 6, 20 a conventional speed control device, 21 calling signals produced when calling registering buttons provided in the cage or at elevator halls as shown in FIG. 8 are depressed with the number of calling signals corresponding to the number of calling registering buttons, and 22 a calling registering circuit for registering the calling signals. The circuit 22, as shown in FIG. 8, is implemented with R-S flip-flops 221, the number of which is equal to the number of the calling registering buttons. When a calling registering button 211*a* is depressed, the corresponding R-S flip-flop 221 is latched so that when the cage reaches the floor designated by the button 211*a*, the R-S flip-flop 221 is reset by a NAND gate 412 and an inverter 411.

In FIG. 2, reference numeral 23 designates a input converter for converting the output of the registering circuit into data for the electronic computer. The input converter 23, as shown in FIG. 8, includes tri-state gates 231*a* the number of which is equal to the number of R-S flip-flops in the registering circuit 22.

Figure 3:
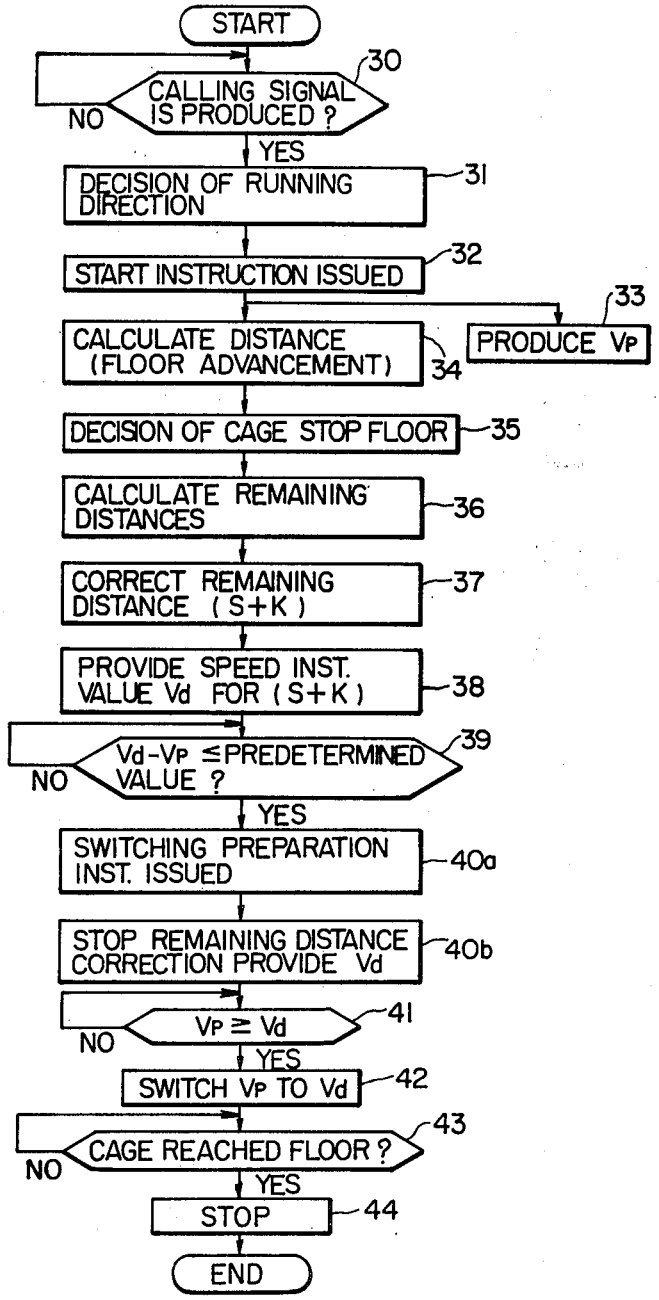
FIG. 3 is a flow chart illustrating the operations of the device in FIG. 2.

FIG. 3 is a flow chart illustrating the operating procedure of the circuit shown in FIG. 2.

The operation of the above-described embodiment of the invention will be described with reference to FIGS. 2 and 3. However, the detailed description of well-known operations of the elevator will be omitted for simplication in description.

It is assumed that, as indicated in Step 30 in FIG. 3, a registering button 211*a* in the cage or at an elevator hall is depressed. In response to this, one (211) of the calling signals 21 is produced, in response to which the output of the calling registering circuit 22 is loaded through the input converter 23 into the CPU 14. Then, as indicated by Step 31, the position of the cage 6 is detected from the content of the up-down counter 12, and the position thus detected is compared with the output of the calling registering circuit 22 to determine the direction of run. As a result, as indicated in Step 32, a start instruction is issued. Next, as indicated in Step 33, the CPU 14 provides a speed instruction value which increases with time and a speed instruction value $Vp_1$ as an analog signal which are applied through the output converter 18 to the speed control device 20, whereby the armature 3 is started.

At Step 34, a deceleration distance (or a floor advancement distance) required for smoothly stopping the cage is calculated. Then, in Step 35, a call at a distance further than the floor advancement distance, i.e. a floor where the cage should be stopped (hereinafter referred to as "a cage stop floor" when applicable) is determined. That is, when the floor advancement distance is changed with the calling of the floor as registered in the registering circuit 21, the cage stop floor is determined.

When the armature 3 is started, the cage 6 is moved by cable sheave 4 and the main cable 5. The generator 19 produces a speed signal representative of the speed of the armature 3 and hence the speed of the cage. The speed signal thus produced is compared with the speed instruction value $Vp_1$ provided in Step 33 to automatically control the speed of the cage whereby the speed of the cage 6 is controlled with high accuracy. Further, the movement of the cage 6 is transmitted through the cable 8 to the disc 10, while the pulse generator 11 outputs pulses which are up-counted or down-counted by the up-down counter 13 depending upon whether the cage 6 is moving upwardly or downwardly. The output of the up-down counter 12 is loaded through the input converter 13 into the CPU 14 and the present position of the cage 6 is calculated from the distance of movement of the cage 6. As a result, in Step 36 (FIG. 3), a remaining distance S to a cage stop floor H (FIG. 4), i.e. a floor registered by the calling registering button 211*a*, is calculated.

Figure 4:
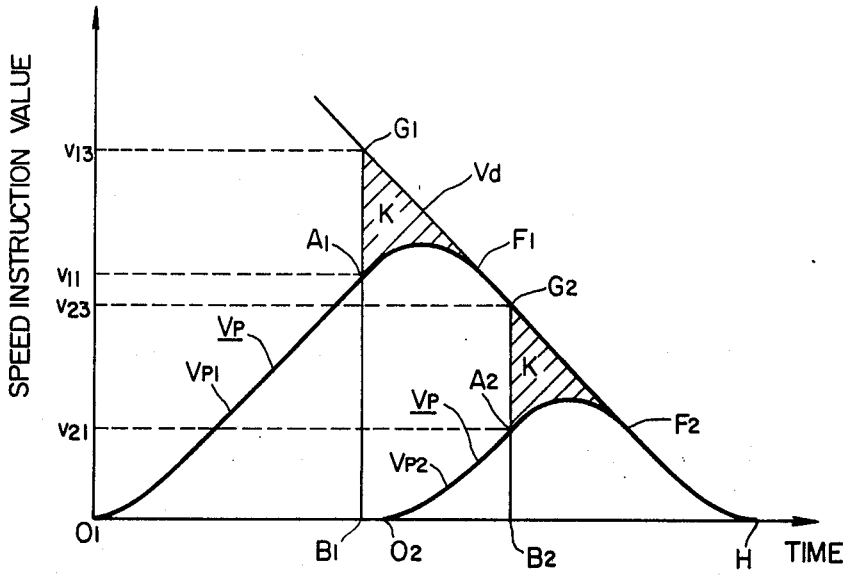
FIG. 4 is a graphical representation indicating speed instruction value curves for a description of the operation of the device in FIG. 2.
Figure 5:
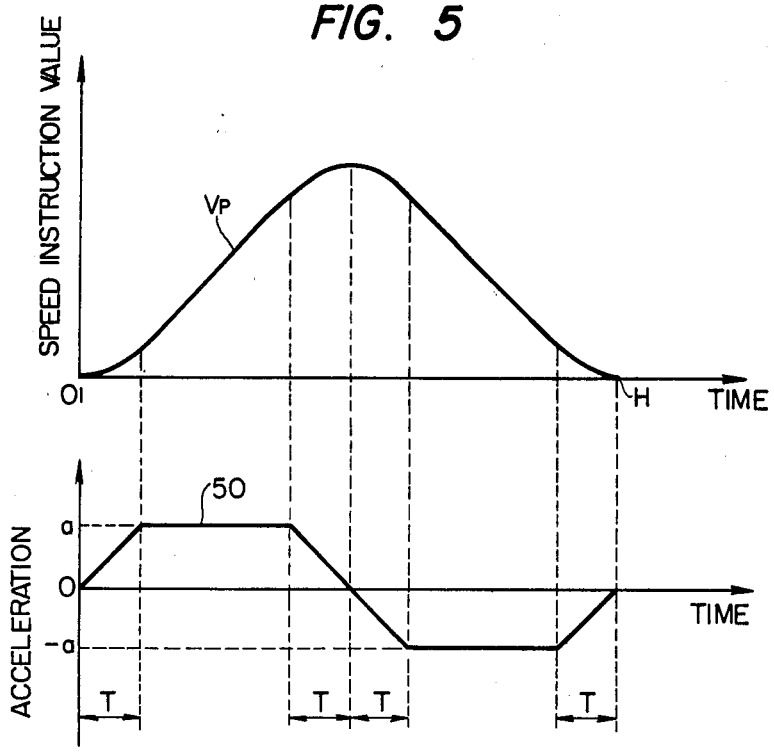
FIG. 5 is also a graphical representation indicating an acceleration curve for a description of the operation of the device in FIG. 2.

In Step 37, a correction distance K is added to the remaining distance S. The correction distance K corresponds to the area $A_1$-$G_1$-$F_1$-$A_1$ in FIG. 4. This area $A_1$-$G_1$-$F_1$-$A_1$ can be calculated as $\frac{3}{4}(aT^2)$ with the acceleration speed waveform defined as shown in FIG. 5. In FIG. 5, reference numeral 50 designates an acceleration curve, reference character a designates a maximum acceleration, $-a$ a maximum deceleration, and T a jerk period. The calculations of Steps 36 and 37 are carried out by the CPU 14.

Next, a speed instruction value Vd for the distance S+K which has been provided through correction in Step 38 is extracted from the ROM 16. The distance corresponding to the distance S+K at the time instant $B_1$ can be represented by the area $B_1$-$G_1$-$F_1$-H-$B_1$. In Step 39, the speed instruction value Vd is compared with the speed instruction value $Vp_1$. If $Vd-Vp_1$ is less than or equal to a predetermined value at the time instant $B_1$, in Step 40*a* a switching preparation instruction (corresponding to the curve $A_1$-$F_1$ in FIG. 4) is issued. In Step 40*b*, the remaining distance correction is suspended, and a speed instruction value Vd for the remaining distance S is extracted from the ROM 16. Thereafter, in Step 41, the speed instruction value Vd extracted in Step 40*b* is compared with the speed instruction value $Vp_1$. If $Vp_1 \geqq Vd$, in Step 42 the speed instruction value $Vp_1$ is switched over to the speed instruction value Vd at the point $F_1$. Thereafter, the speed instruction value Vd decreases and the speed of the cage 6 is decreased in accordance with the speed instruction value Vd. When, in Step 43, it is confirmed that the cage 6 has reached the floor, then in Step 44 the cage 6 is stopped.

As in the above-described case, in the case where the cage is run at low speed, a speed instruction value Vd for a corrected remaining distance S+K is extracted from the ROM 16 and the value Vd thus extracted is compared with the speed instruction value $Vp_2$. If $Vd-Vp_2$ is less than or equal to a predetermined value at the time instant $B_2$, a switching preparation instruction is issued. The speed instruction value $Vp_2$ is switched over to the speed instruction value Vd at the point $F_2$ where $Vp_2 \geqq Vd$.

Figure 1:
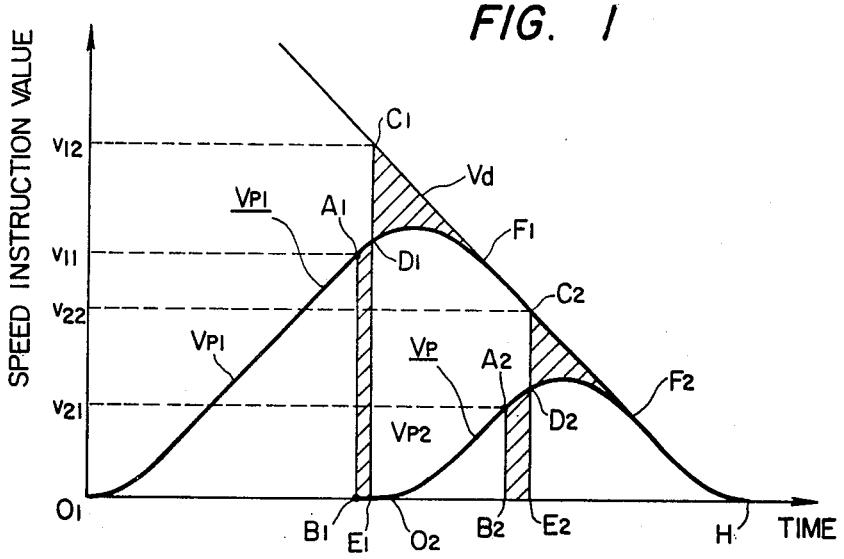
FIG. 1 is a graphical representation showing speed instruction value curves for a description of the operation of a conventional speed instruction generating device for an elevator.

Both the areas $A_1$-$G_1$-$F_1$-$A_1$ and $A_2$-$G_2$-$F_2$-$A_2$ are equal to K irrespective of speed. Accordingly, the difference Vs between the speed instruction value Vd and the speed instruction value $Vp_1$ and the difference Vs between the speed instruction value Vd and the speed instruction value $Vp_2$ are constant irrespective of speed (or $Vs=v_{13}-v_{11}=v_{23}-v_{21}=$constant). Therefore, in accordance with the preferred embodiment of the invention, unlike the case of FIG. 1, it is not necessary to change the difference Vs with speed, and accordingly the programs in the electronic computer can be simplified.

Figure 9:
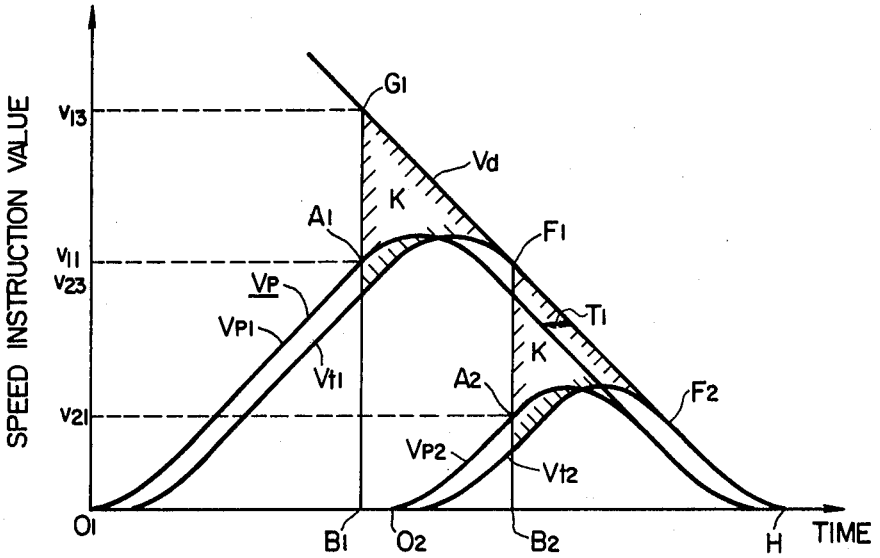
FIGS. 9 and 10 are graphical representations indicating speed instruction value curves for a description of the operations of other embodiments of the device according to the invention.

FIG. 9 illustrates another embodiment of the invention in which the delay in the control system is taken into account. The actual speed of the cage is given by a speed instruction value $Vt_1$ which is delayed by a period of time $T_1$ from the speed instruction value $Vp_1$. Similarly, the actual speed of the cage is given by a speed instruction value $Vt_2$ which is delayed from the speed instruction speed $Vp_2$. In this case, the correcting distance K can be obtained from $a(T_1^2+2TT_1+(4/3T^2)$, and $v_{13}-v_{11}=v_{23}-v_{21}=$constant irrespective of speed. However, it should be noted that, in this case, instead Vd, $Vd-a\,T_1$ is employed as the second speed instruction value after the switching preparation point has been passed.

Figure 10:
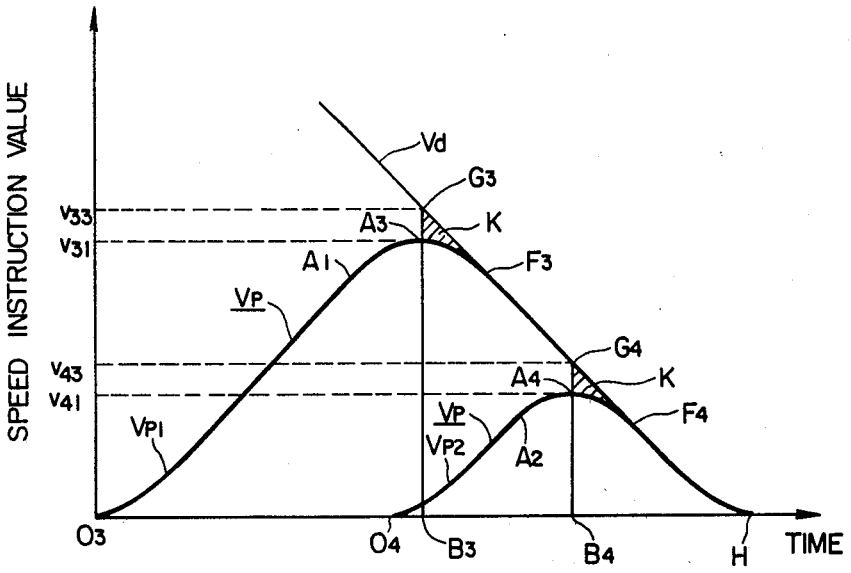

A third embodiment of the invention is illustrated in FIG. 10. In this embodiment, the switching preparation points $A_1$ and $A_2$ described with reference to FIG. 4 are detected by a separate device and the deceleration start points $A_3$ and $A_4$ are employed as switching preparation points. In this case, the correcting distance K can be obtained as $(1/6)(aT^2)$, and $v_{33}-v_{31}=v_{43}-v_{41}=$constant irrespective of speed.

In the above-described embodiment, the speed instruction value $Vp_1$ and $Vp_2$ is switched over to the speed instruction value Vd when the two values coincide. However, the circuit may be so designed that the speed instruction value $Vp_1$ or $Vp_2$ is switched over to the speed instruction value Vd after the lapse of a predetermined period of time from the switching preparation instruction points $A_1$ through $A_4$.

As is apparent from the above description, in accordance with the invention, a predetermined distance is added to the remaining distance from the present position of the cage to a cage stop floor, a second speed instruction value corresponding to the resultant distance is obtained, and when the difference between the second speed instruction value and the first speed instruction value becomes smaller than a predetermined value, a switching preparation instruction is issued, so that the first speed instruction value is employed as the speed instruction value of the cage until the predetermined period of time has passed thereafter upon which a first speed instruction value is switched over to the second speed instruction value which is used as the speed instruction value of the cage. Accordingly, the difference between the first speed instruction value and the second speed instruction value is constant irrespective of speed. Therefore, although the construction of the speed instruction generating device is simple, a shock force which otherwise may be caused at the time of switching of the speed instruction value is eliminated.

What is claimed is:

1. A method for controlling the movement of an elevator, comprising the steps of: moving an elevator cage at a speed determined by a first speed instruction value toward a floor at which said cage is to be stopped; determining a distance remaining from a present position of said cage to said floor at which said cage is to be stopped; adding a predetermined distance to said remaining distance; determining a second speed instruction value in accordance with the sum of said predetermined distance and said remaining distance; determining a difference between said second speed instruction value and said first speed instruction value; issuing a switching preparation instruction when said difference becomes smaller than a predetermined value; and moving said elevator cage at a speed determined in accordance with said second speed instruction value a predetermined period of time after said switching preparation instruction is issued, wherein a difference between said first speed instruction value and said second speed instruction value is constant irrespective of the speed of said elevator cage.

2. The method of claim 1 further comprising the step of producing a speed instruction value which is used to control the speed of movement of said cage, said speed instruction value being delayed by a predetermined period of time from the corresponding one of said first speed instruction value and said second speed instruction value.

3. A method for controlling the movement of an elevator cage, comprising the steps of: setting a digital value in a calling registering circuit in response to actuation of a registering button; loading an output of said calling registering circuit through an input converter into a central processing unit; determining the position of said cage of said elevator with an up-down counter; comparing an output of said up-down counter with said output of said calling registering circuit to determine a direction of running of said cage; issuing a start instruction signal; determining a first speed instruction value which increases with time; applying said first speed instruction value to a speed control device for controlling the speed of running of said cage; determining a present position of said cage from a distance of movement of said cage; determining a remaining distance to a floor where said cage is to be stopped in response to a result of said step of determining said present position; adding a correction distance to said remaining distance; extracting a speed instruction value corresponding to the sum determined in said step of adding said correction distance from a memory; determining a difference between said speed instruction value corresponding to said sum and said first speed instruction value; issuing said switching preparation instruction if said difference is less than or equal to a predetermined value at a predetermined time instant; extracting a speed instruction value corresponding to a remaining distance to said floor where said cage is to be stopped from said memory; comparing said speed instruction value corresponding to said remaining difference with said first speed instruction value; applying said speed instruction value corresponding to said remaining distance to said speed control device, wherein the speed of said cage decreases in accordance with said speed instruction value corresponding to said remaining distance; and stopping said cage when said cage has reached said floor.

4. The method of claim 3 further comprising the step of calculating said correction distance in accordance with $4/3 \cdot aT^2$, wherein a corresponds to a maximum acceleration of said cage and T is a jerk speed of said cage.

5. The method of claim 3 further comprising the step of delaying a speed instruction value applied to said output converter by a predetermined period of time.

6. The method of claim 5 further comprising the step of calculating said correcting distance in accordance with $a(T_1^2+2TT_1+3/4T^2)$, wherein a is a maximum acceleration of said cage, $T_1$ is predetermined period of time, and T is a jerk speed of said cage and wherein a value of $aT_1$ is subtracted from the speed instruction value applied to said speed control device after a predetermined point has been reached.

7. The method of claim 3 wherein said predetermined point is detected by a detecting device for detecting the passage of said cage past said predetermined point wherein said predetermined point is set in accordance with a deceleration start point; and wherein said correction distance is calculated in accordance with $1/6 \cdot aT^2$.

8. The method of any one of claims 3–7 wherein said step of applying said speed instruction value corresponding to said remaining distance a predetermining period of time after said cage reaches a predetermined switching preparation instruction point.

* * * * *